US007048838B2

(12) United States Patent
Katayama et al.

(10) Patent No.: US 7,048,838 B2
(45) Date of Patent: May 23, 2006

(54) ION EXCHANGE MEMBRANE ELECTROLYZER

(75) Inventors: Shinji Katayama, Tamano (JP); Masaru Mori, Tamano (JP); Masakazu Kameda, Tamano (JP)

(73) Assignee: Chlorine Engineers Corp., Ltd., Tokyo (JP)

( * ) Notice: Subject to any disclaimer, the term of this patent is extended or adjusted under 35 U.S.C. 154(b) by 324 days.

(21) Appl. No.: 10/368,380

(22) Filed: Feb. 20, 2003

(65) Prior Publication Data

US 2003/0155232 A1 Aug. 21, 2003

(30) Foreign Application Priority Data

Feb. 20, 2002 (JP) ..... 2002-043599

(51) Int. Cl.
*C25B 9/10* (2006.01)
*C25B 9/20* (2006.01)
*C25B 13/02* (2006.01)
*C25B 13/04* (2006.01)

(52) U.S. Cl. ..... 204/252; 204/253; 204/254; 204/255; 204/267; 204/275.1; 204/278.5; 204/288.1; 204/288.3; 205/334; 205/344

(58) Field of Classification Search ..... 204/252–258, 204/279, 288.3, 290 R, 267, 275.1, 278.5, 204/288.1; 429/34–35; 205/640, 334, 344
See application file for complete search history.

(56) References Cited

U.S. PATENT DOCUMENTS 4,279,731 A 7/1981 Pellegri ..... 204/254
5,174,878 A * 12/1992 Wullenweber et al. ..... 204/254

FOREIGN PATENT DOCUMENTS

EP 0 905 283 3/1999
EP 0 960 960 12/1999
EP 1 067 216 1/2001

OTHER PUBLICATIONS

European Search Report dated Aug. 28, 2003.

* cited by examiner

*Primary Examiner*—Roy King
*Assistant Examiner*—Lois Zheng
(74) *Attorney, Agent, or Firm*—Westerman, Hattori, Daniels & Adrian, LLP

(57) ABSTRACT

The invention provides an ion exchange membrane electrolyzer ensuring a satisfactory circulation of electrolyte, high electrolytic efficiency and great ridigity. An anode chamber partition in a flat sheet form is joined to a cathode chamber partition in a flat sheet form. An electrode retainer member in a sheet form is joined to at least one partition at a belt-like junction. A projecting strip with an electrode joined thereto is located between adjacent junctions. A space on an electrode surface side of the electrode retainer member defines a path through which a fluid goes up in the electrode chamber, and a space that spaces away from the space defines a path through which an electrolyte separated from a gas at a top portion of the electrode goes down.

6 Claims, 9 Drawing Sheets

(A)

(B)

(A)

(B)

(A)

(B)

(C)

ION EXCHANGE MEMBRANE ELECTROLYZER

BACKGROUND OF THE INVENTION

The present invention relates generally to an ion exchange membrane electrolyzer, and more particularly to a bipolar filter press type ion exchange membrane electrolyzer.

A currently available bipolar filter press type ion exchange membrane electrolyzer built up of a number of electrolyzer cell units stacked one upon another via ion exchange membranes, wherein each electrolyzer cell unit comprises an anode partition and a cathode partition which are mechanically and electrically joined together.

FIGS. 8(A) and 8(B) are illustrative of one conventional ion exchange membrane electrolyzer.

FIG. 8(A) is a schematic of one electrolyzer cell unit for a bipolar ion exchange membrane electrolyzer as viewed from an anode chamber, and FIG. 8(B) is a sectional view taken on line A—A of FIG. 8(A).

An anode chamber partition 54 and a cathode chamber partition 55 forming an anode chamber 52 and a cathode chamber 53 of an electrolyzer cell unit 51 are provided with anode ribs 56 and cathode ribs 57 at given intervals. Each anode rib 56 is provided with an anode 58, while each cathode rib 47 is provided with a cathode 59.

For an ion exchange membrane electrolyzer having a height of 1 m or so in its longitudinal direction and a width of 2 m or so in the lateral direction, it is required to decrease the concentration distribution of electrolyte in each electrode chamber, thereby carrying out electrolysis with efficiency. Decreasing the concentration distribution within the electrode chamber may be achieved by a method of circulating electrolyte with an externally provided electrolyte-circulating pump. There is also available another method that dispenses with any external circulating pump, in which the electrolyte is circulated by use of the buoyancy force of the gas generated by electrolysis. So far, it has been proposed to locate an internal circulation member in the electrode chamber for the purpose of achieving smooth internal circulation.

However, the location of the internal circulation member in the electrode chamber in addition to anode and cathode ribs leads to the need of many other members for the construction of an electrolyzer, and the performance of internal circulation is still less than satisfactory.

FIGS. 9(A) and 9(B) are illustrative of a prior art ion exchange membrane electrolyzer of another construction.

FIG. 9(A) is a schematic of an electrolyzer cell unit for a bipolar type ion exchange membrane electrolyzer as viewed from an anode chamber side, and FIG. 9(B) is a perspective view of a partition.

The electrolyzer shown in FIGS. 9(A) and 9(B) is a bipolar type ion exchange membrane electrolyzer proposed by the present applicant in U.S. Pat. No. 5,314,591, etc.

In an electrolyzer cell unit 51, an anode chamber partition 54 and a cathode chamber partition forming an anode chamber 52 and a cathode chamber, respectively, are provided with recess/projection combinations of similar configuration, which engage the anode chamber partition 54 integrally with the cathode chamber partition, so that a mixed gas-liquid fluid generated at the electrode goes up along a recess 60 and electrolyte goes down between an electrolyte-circulating path-forming member 61 located in the electrode chamber and the anode chamber partition 54, thereby ensuring the internal circulation of electrolyte in the electrolyzer. In this electrolyzer, the circulation of electrolyte leaves a good deal to be desired because the electrolyte-circulating path is defined by a space between the electrolyte-circulating path-forming member and the partition having a recess/projection combination.

A primary object of the present invention is to provide an ion exchange membrane electrolyzer which has great rigidity with improvements in the internal circulation of electrolyte that makes use of an upward flow of the gas generated in the anode and cathode chambers and a downward flow of electrolyte from which the gas is removed and, hence, an improved electrolysis efficiency.

SUMMARY OF THE INVENTION

Figure 1:
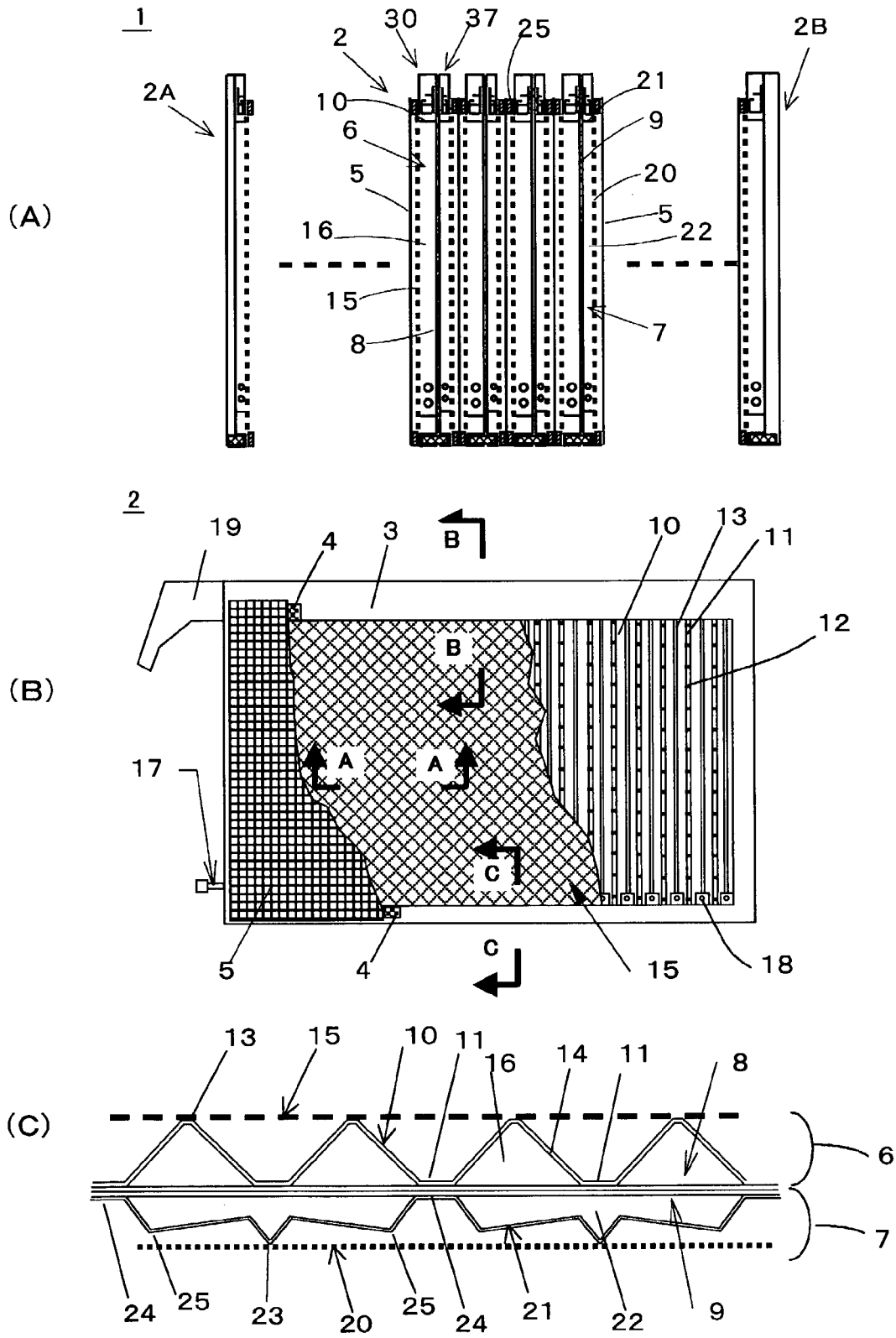
FIGS. 1(A), 1(B) and 1(C) are illustrative of one embodiment of the ion exchange membrane electrolyzer according to the present invention.

The present invention provides an ion exchange membrane electrolyzer, wherein:

an anode chamber partition in a flat sheet form is joined to a cathode chamber partition in a flat sheet form, an electrode retainer member in a sheet form is joined to at least one of said anode chamber partition and said cathode chamber partition at a belt-like junction, a projecting strip with an electrode joined thereto is located between adjacent junctions, a space on an electrode surface side of said electrode retainer member defines a path through which a fluid goes up in the electrode chamber, and a space that spaces away from said space defines a path through which an electrolyte separated from a gas at a top portion of the electrode goes down.

In the ion exchange membrane electrolyzer, the junctions of the electrode retainer member are each joined to the projecting strip by means of one plane.

In the ion exchange membrane electrolyzer, the projecting strip of the electrode retainer member is formed on a plane parallel with the electrode partition.

In the ion exchange membrane electrolyzer, either one of the anode retainer member and the cathode retainer member is formed of a springy member.

In the ion exchange membrane electrolyzer, said springy member is formed of a flexible member comprising between the adjacent junctions at least three projecting strips extending away from a junction side with the partition.

In the ion exchange membrane electrolyzer, the electrode is joined to a projecting strip of said projecting strips, which has a largest amount of displacement upon receipt of pressure.

In the ion exchange membrane electrolyzer, the projecting strip having the largest amount of displacement is formed by partial notching.

In the ion exchange membrane electrolyzer, the projecting strip having the largest amount of displacement is joined with the electrode via a protective member for the projecting strip, wherein an amount of displacement of said protective member upon the electrode coming into contact with a projecting strip near to a junction is given by a maximum angle of opening of the projecting strip.

In the ion exchange membrane electrolyzer, when the electrode joined to the projecting strip having the largest amount of displacement is urged toward a partition side, movement of the electrode is limited by a projecting strip adjacent to a junction.

DESCRIPTION OF THE PREFERRED EMBODIMENT

In the ion exchange membrane electrolyzer of the present invention, partitions for partitioning an anode chamber from a cathode chamber are each formed of a flat sheet, and an electrode retainer member is joined to each partition in a flat sheet form at a junction between the partitions while a sheet form of projecting strip with an electrode joined thereto is located between adjacent junctions. The electrode retainer acts as a structural member of an electrolyzer cell unit for retaining the electrolyzer to increase the rigidity of the electrolyzer, and the circulation path of electrolyte is extended all over the surface of the electrode chamber, thereby providing a more satisfactory circulation of electrolyte in the electrode chamber and, hence, making electrolytic efficiency much higher than ever before.

The present invention is now explained specifically with reference to the accompanying drawings.

FIGS. 1(A), 1(B) and 1(C) are illustrative of one embodiment of the ion exchange membrane electrolyzer of the present invention.

FIG. 1(A) is illustrative in section of one embodiment of the ion exchange membrane electrolyzer of the invention in which a plurality of electrolyzer cell units are stacked one upon another, and FIG. 1(B) is a view of the electrolyzer unit as viewed from an anode chamber side. FIG. 1(C) is a sectional view taken on line A—A of FIG. 1(B).

As shown in FIG. 1(A), an ion exchange membrane electrolyzer generally shown at 1 is built up of a plurality of bipolar electrolyzer cell units 2 stacked one upon another via ion exchange membranes 5, with a gasket 4 mounted on a flange surface 3 of each unit 2. The electrolyzer 1 is provided at one end with a cathode chamber unit 2A having a cathode chamber side alone and at the other end with an anode chamber unit 2B having an anode chamber side alone.

An anode chamber 6 of each electrolyzer cell unit 2 is provided therein with an anode 15 at a spacing from an anode chamber partition 8. A cathode chamber 7 is provided therein with a cathode 20 at a spacing from a cathode chamber partition 9, so that the cathode chamber 7 is formed between the cathode chamber partition 9 and the ion exchange membrane 5.

A gas-liquid separation means 30 is mounted on the top of the anode chamber 6, and a gas-liquid separation means 37 is mounted on the top of the cathode chamber 7.

Each bipolar type electrolyzer cell unit 2 of the ion exchange membrane electrolyzer is built up of the anode chamber 6 and the cathode chamber 7, and the anode chamber partition 8 in a flat plate form is electrically and mechanically joined to and integrated with the cathode chamber partition 9 again in a flat plate form.

An anode retainer member 10 is joined to the anode chamber partition 8 at a belt-like junction 11 at which the anode chamber partition 8 comes into close contact with the anode retainer member 10. It is not always required to weld the anode chamber partition 8 continuously all over the anode retainer member 10; in other words, it is acceptable to join both together at a number of spot welding sites 12 so that the anode retainer member 10 comes into close contact with the anode chamber partition 8 thereby ensuring an electrically conductive connection between both while a space formed between both is isolated from the opposite space.

A projecting strip 13 is formed between adjacent belt-like junctions 11 of the anode retainer member 10, and the projecting strip 13 is joined to each junction 11 by way of a planar portion 14. The anode 15 is joined to the projecting strip 13 at plural sites so that the anode 15 is retained in place and an electrolytic current is passed to the anode 15.

The projecting strip 13 should preferably have a width large enough to ensure that the electrode can be joined to an apex portion thereof. For instance, the projecting strip may be formed by bending a metal sheet in a triangular form or in such a way that the electrode retainer member forms a plane parallel with the partition. The anode retainer member may be formed as a separate member or a member of mutually joined pieces may be formed by press molding. Alternatively, all anode retainer members located at the anode chamber partition may be prepared by forming one metal sheet.

The junction 11 and the projecting strip 13 joined together by way of the planar portion 14 provides a truss section that improves on the rigidity of the anode chamber formed of a thin sheet.

The anode retainer member 10, the anode chamber partition 8 and the adjacent belt-like junctions 11 create together a space that defines an anode fluid-circulating path 16. A mixed gas-liquid fluid goes up in a space on the side of the surface of the anode retainer member 10 facing the anode 15 and arrives at an upper portion of the anode chamber where the gas is separated from the fluid. A part of the thus separated electrolyte is discharged through an anode fluid port 19. The rest goes down through the anode fluid-circulating path 16 and arrives at a lower portion of the anode chamber, from which it flows into a space on the anode surface side. Then, the fluid is mixed with an anode fluid supplied from an anode fluid supply pipe 17 and injected through an anode fluid-injecting port 18 into the anode chamber for electrolysis at the anode 15.

In the cathode chamber 7, on the other hand, a cathode 20 is attached to a cathode retainer member 21 joined to the cathode chamber partition 9, as shown in FIG. 1(C), so that a cathode fluid-circulating path 22 is formed between the cathode chamber partition 9 and the cathode retainer member 21.

The cathode retainer member 21 joined to the cathode chamber partition 9 is a springy member that has a horizontally symmetrical section as cut along a plane at right angles with the flow direction of a cathode fluid through the cathode fluid-circulating path 22. The cathode retainer member 21 is joined to the cathode chamber partition 9 at belt-like junctions 24 on both sides of a projecting strip 23 with the cathode 20 attached thereto, and another projecting strip 25 adjacent to the junction 24 is provided on a junction side, and the projecting strip 23 with the cathode 20 attached thereto projects toward the opposite electrode side in a larger amount than do the junction-side strips 25 on both its sides. The spring properties of the cathode retainer member ensure that a given spacing is provided between the cathode 20 and the ion exchange membrane surface.

In the ion exchange membrane electrolyzer of the present invention, the partitions for partitioning the anode chamber from the cathode chamber are each formed of a flat sheet, and the electrode retainer member is joined to each partition in a flat sheet form at the junction between the partitions while a sheet form of projecting strip with the electrode joined thereto is located between the adjacent junctions. The circulation path of electrolyte is extended all over the surface of the partition, thereby providing a more satisfactory circulation of electrolyte in the electrode chamber and ensuring that an electrolyzer of great rigidity is obtained.

As shown in FIG. 1(C), it is preferable to locate the junction 24 with the cathode retainer member 21 on the cathode chamber partition 9 on the back surface side of the junction 11 between the anode chamber partition 8 and the anode retainer member 10. This arrangement is favorable because the length of the current conduction path from the anode side to the cathode side can be reduced.

Figure 2:
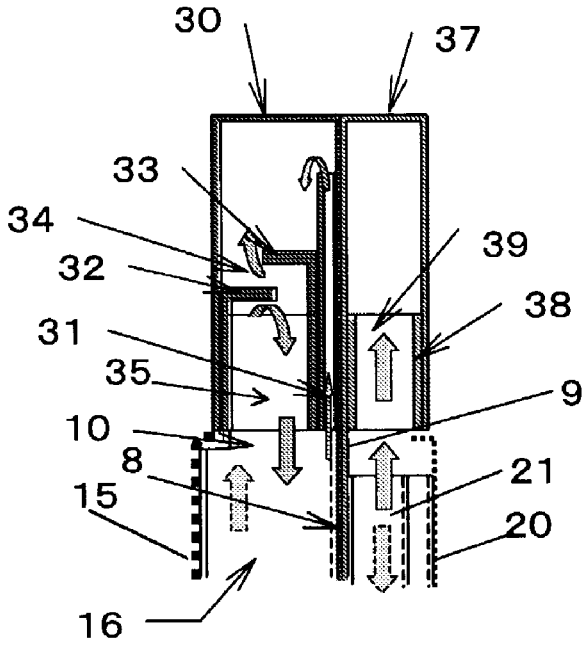
FIGS. 2(A) and 2(B) are illustrative of one embodiment of the electrolyte-circulating mechanism for the ion exchange membrane electrolyzer according to the present invention.
Figure 2:
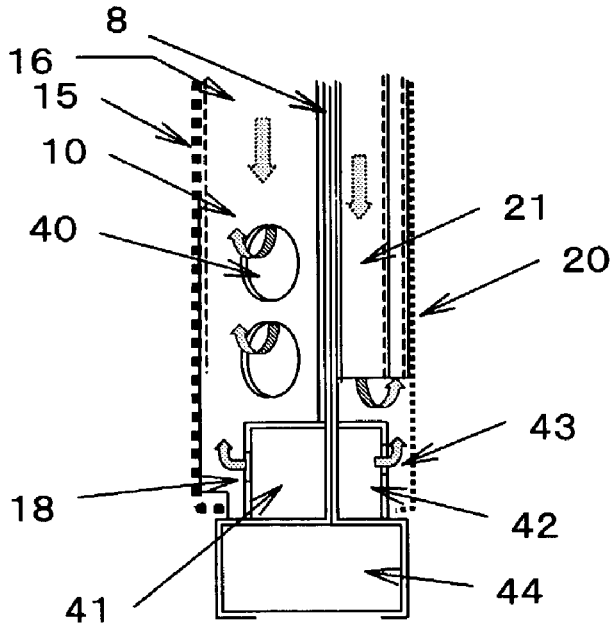

FIGS. 2(A) and 2(B) are illustrative of one embodiment of the electrolyte-circulating mechanism for ion exchange membrane electrolyzer of the present invention.

FIG. 2(A) is a sectional view taken on line B—B of FIG. 1(A), illustrating a gas-liquid separation chamber positioned on the top of the electrolyzer.

An anode side gas-liquid separation chamber 30 is provided on the top of the anode chamber, which is located above an electrolytic area. The anode side gas-liquid separation chamber 30 is provided on an anode chamber partition 8 side with a partition side path 31 for communicating the electrolytic area with the anode side gas-liquid separation chamber 30. A first divider member 32 of L shape in section is located to partially divide the anode side gas-liquid separation chamber 30 into an upper region and a lower region, and a second divider member 33 of L shape in section is located at a position higher than the first divider member 32, extending from the partition side to partially divide the anode side gas-liquid separation chamber 30 into an upper portion and a lower portion. Between the first divider member 32 and the second divider member 33 there is thus provided a communication path 34.

A bubble-containing, mixed gas-liquid fluid generated by electrolysis goes up in a space defined between the anode retainer member 10 and the anode 15, flowing in the anode side gas-liquid separation chamber 30 by way of the partition side path 31 and the communication path 34, where the generated gas is separated from the fluid. The thus separated electrolyte overflows the upper end of the anode retainer member, going down to the bottom of the anode chamber by way of the anode fluid-circulating path 16 defined by the anode chamber partition and the anode retainer member.

The first divider member 32 and the second divider member 33 located in the anode side gas-liquid separation member 30 may be formed by a part of an anode chamber frame that provides an anode chamber structure. Alternatively, a partitioning sheet 35 may be inserted in the anode side gas-liquid separation chamber 30 for joining to the first 32 and the second divider member 33 formed by a part of the anode chamber frame. Thus, deformation of electrolyzer cell units due to loads can be prevented upon such cell units stacked one upon another into an electrolyzer, so that an electrolyzer having great rigidity can be set up.

On the top of the cathode chamber above an electrolytic area, there is provided a cathode side gas-liquid separation chamber 37. A mixed gas-liquid fluid goes up in a space defined by the cathode 20 and the cathode retainer member 21, arriving at that chamber 37 where the gas is separated from the fluid. Then, the separated liquid goes down to the bottom of the cathode chamber by way of a cathode fluid-circulating path 20 defined by the cathode retainer member 21 and the cathode partition 9.

In the cathode side gas-liquid separation chamber 37, too, a part of a cathode chamber frame 38 that forms a cathode chamber structure is provided and a partitioning sheet 39 is inserted at a given spacing from the cathode chamber frame 38, thereby preventing deformation of electrolyzer cell units due to loads upon such cell units stacked one upon another into an electrolyzer. It is thus possible to set up an electrolyzer having great rigidity.

FIG. 2(B) is a sectional view taken on line C—C of FIG. 1(A), illustrating an electrolyte circulation mechanism for the lower portion of the electrolyzer.

An anode retainer member 10 in the lower portion of the electrolyzer is provided with a port 40 for injection of a downflow fluid. An anode fluid separated from the gas in the gas-liquid separation chamber, going down through the anode fluid-circulating path 12 defined by the anode retainer member 10 and the anode chamber partition 8, is injected from the downflow fluid port 40 into the electrode chamber. Then, the thus injected fluid is mixed with an anode fluid injected from an anode fluid-injecting port 18 into the anode chamber by way of an anode fluid supply path 41 provided in the lower portion of the anode chamber joined to an anode fluid supply pipe, and the mixture is electrolyzed at the anode 15 surface.

Likewise, a cathode fluid going down from an opening in the lower portion of the cathode retainer member 21 is injected into the lower portion of the cathode chamber, and electrolyzed at the cathode 20 together with a cathode fluid injected from a cathode fluid-injecting port 43 by way of a cathode fluid supply path 42 connected to a cathode fluid supply pipe.

Below the electrolyzer unit cell 2 there is provided an electrolyzer frame 44 that retains a mechanical structure of the electrolyzer and maintains the rigidity of the electrolyzer.

While the present invention has been described with reference to a specific embodiment wherein the gas-liquid separation chamber having enhanced gas-liquid separation capability and electrolyte circulation capability is provided for the anode chamber susceptible to air bubbles in the electrode chamber and the concentration distribution of electrolyte, it is acceptable to provide for the cathode chamber a gas-liquid separation chamber similar in construction to the anode side gas-liquid separation chamber.

FIGS. 3(A) and 3(B) are illustrative of another embodiment of the ion exchange membrane electrolyzer of the present invention.

FIG. 3(A) is a schematic of an electrolyzer cell unit as viewed from an anode chamber side, and FIG. 3(B) is a sectional view taken on line A—A of FIG. 3(A).

An electrolyzer cell unit 2 is made up of an anode chamber 6 and a cathode chamber 7. An anode chamber partition 8 in a flat sheet form is electrically and mechanically joined to and integrated with the anode chamber 6 while a cathode chamber partition 9 again in a flat sheet form is electrically and mechanically joined to and integrated with the cathode chamber 7.

An anode retainer member 10 is joined to the anode chamber partition 8 at a belt-like junction 11. More specifically, at the belt-like junction 11 the anode chamber partition 8 and the anode retainer member 10 are joined together in a close contact relation. The anode retainer member 10 is composed of a longitudinal portion connected to the junction 11 and a lateral portion 10B parallel with the anode chamber partition 8 intersecting at right angles with the longitudinal portion 10A. The lateral portion 10B is provided with a projecting strip 13 to which the anode 15 is joined at plural sites, thereby retaining the anode 15 through the anode retainer member 10 and passing an electrolytic current to the anode 15.

The projecting strip 13 should preferably have a width large enough to join the electrode to its apex. The projecting strip 13 may be formed of an angled metal sheet with apexes as shown in FIG. 3(B) or, alternatively, such apexes may be of flat shape. The anode chamber partition 8 and the anode retainer member 10 form an anode fluid-circulating path 16 with the belt-like junction.

Figure 3:
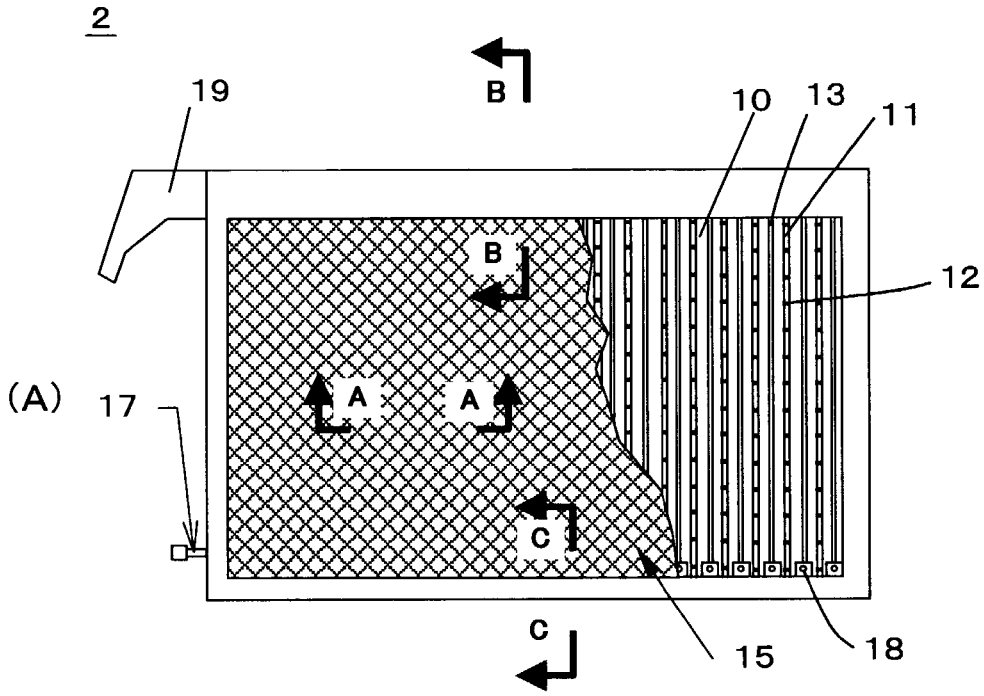
FIGS. 3(A) and 3(B) are illustrative of another embodiment of the ion exchange membrane electrolyzer according to the present invention.
Figure 3:
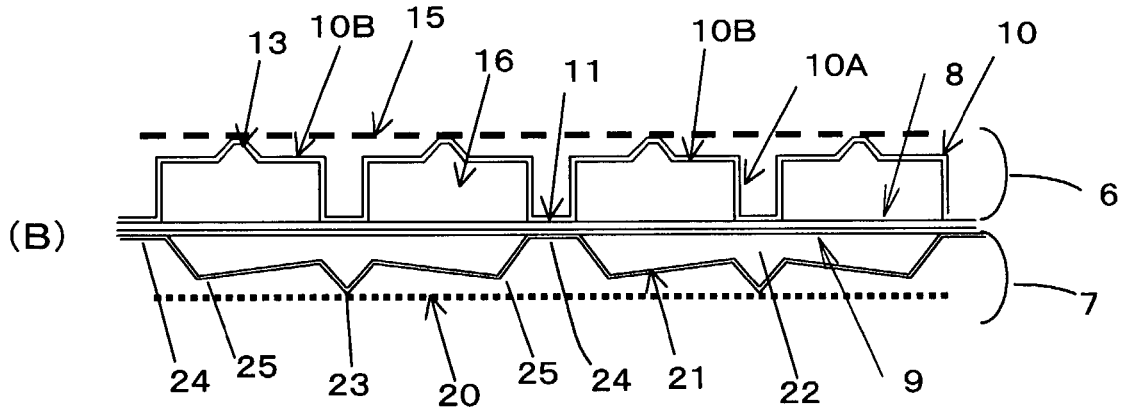

With the anode retainer member 10 configured as shown in FIG. 3, the sectional area of the anode fluid-circulating path 16 can easily be adjusted by varying the height or angle of the longitudinal portion 10A joined to the junction, so that the ratio of the sectional area of the anode fluid-circulating path 16 to the sectional area of the anode chamber can arbitrarily be varied.

The anode retainer member 10 is uniformly joined to the flat sheet form of anode chamber partition 8 all across its width and the anode 15 is joined to the projecting strip 13 of the anode retainer member 10, thereby ensuring uniform circulation of the anode fluid in the anode chamber and imparting great strength to the electrolyzer.

A mixed gas-liquid fluid goes up in a space on the side of the surface of the anode retainer member 10 facing the anode 15 and arrives at the top portion of the anode chamber, where the gas is separated from the fluid. The thus separated electrolyte goes down through the anode fluid-circulating path 16 and arrives at the bottom of the electrode chamber, from which the electrolyte flows into a space on the electrode surface side and is then electrolyzed at the anode 15 together with an anode fluid supplied from an anode fluid supply pipe 17 provided to the electrolyzer and injected from an anode fluid-injecting port 18 into the electrode chamber.

In the cathode chamber 7, a cathode 20 is attached to a cathode retainer member 21 joined to a cathode chamber partition 9 as is the case of FIG. 1(B), so that between the cathode chamber partition 9 and the cathode retainer member 21 there is formed a cathode fluid-circulating path 22.

The cathode retainer member 21 joined to the cathode chamber partition 9 is a springy member that has a horizontally symmetrical section as cut along a plane at right angles with the flow direction of a cathode fluid through the cathode fluid-circulating path 22. The cathode retainer member 21 is joined to the cathode chamber partition 9 at belt-like junctions 24 on both sides of the projecting strip 23 with the cathode 20 attached thereto, and another projecting strip 25 adjacent to the junction 24 is provided on a junction side, and the projecting strip 23 with the cathode 20 attached thereto projects toward the opposite electrode side in a larger amount than do the junction-side angle strips 25 on both its sides, so that the distance between the cathode 20 and the surface of the ion exchange membrane is kept short.

Figure 4:
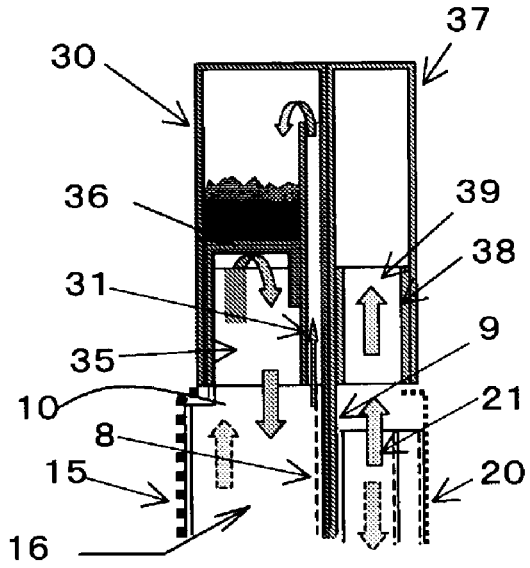
FIGS. 4(A) and 4(B) are illustrative of another embodiment of the electrolyte-circulating mechanism for the ion exchange membrane electrolyzer according to the present invention.
Figure 4:
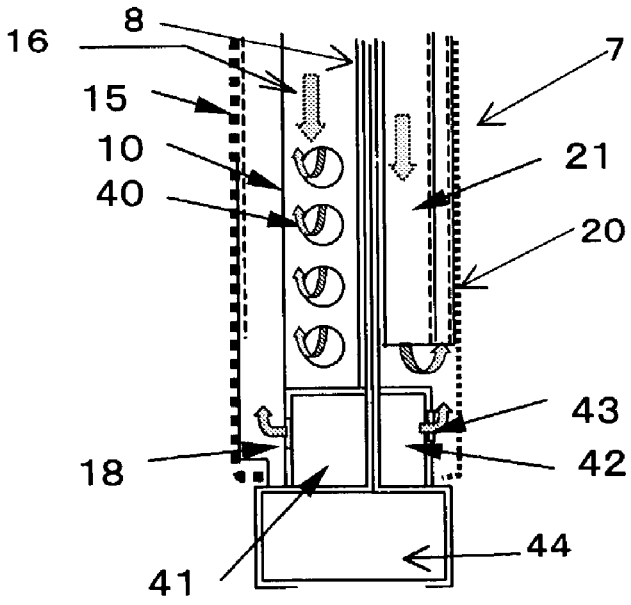

FIGS. 4(A) and 4(B) are illustrative of another embodiment of the electrolyte-circulating mechanism for the ion exchange membrane electrolyzer of the present invention.

FIG. 4(A) is a sectional view taken on line B—B of FIG. 3(A), illustrating another embodiment of the gas-liquid separation chamber positioned on the top of the electrolyzer.

An anode side gas-liquid separation chamber 30 is provided on the top of the anode chamber, which is located above an electrolytic area. The anode side gas-liquid separation chamber 30 is provided on an anode chamber partition 8 side with a partition side path 31 for communicating the electrolytic area with the anode side gas-liquid separation chamber 30. A divider member 36 extends from an anode side surface to divide the anode chamber side gas-liquid separation chamber 30 joined to a member that forms a wall surface of a partition side passage 31 into an upper region and a lower region.

A bubble-containing, mixed gas-liquid fluid generated by electrolysis goes up in a space defined between the anode retainer member 10 and the anode 15, flowing in the anode side gas-liquid separation chamber 30 by way of the partition side path 31, where the generated gas is separated from the fluid. The thus separated electrolyte overflows the upper end of the anode retainer member, going down to the bottom of the anode chamber by way of the anode fluid-circulating path 16 defined by the anode chamber partition and the anode retainer member.

The divider member 36 located in the anode side gas-liquid separation member 30 may be formed by a part of an anode chamber frame that provides an anode chamber structure. Alternatively, a partitioning sheet 35 may be inserted in the anode side gas-liquid separation chamber 30 for joining to the divider member 36. Thus, deformation of electrolyzer units due to loads can be prevented upon such cell units stacked one upon another into an electrolyzer, so that an electrolyzer having great rigidity can be set up.

On the top of the cathode chamber above an electrolytic area, there is provided a cathode side gas-liquid separation chamber 37. A mixed gas-liquid fluid goes up in a space defined by the cathode 20 and the cathode retainer member 21, arriving at the chamber 37, where the gas is separated from the fluid. Then, the separated liquid goes down to the bottom ofthe cathode chamber by way of a cathode fluid-circulating path 22 defined by the cathode retainer member 21 and the cathode partition 9.

In the cathode side gas-liquid separation chamber 37, too, a part of a cathode chamber frame 38 that forms a cathode chamber structure is provided and a partitioning sheet 39 is inserted at a given spacing from the cathode chamber frame 38, thereby preventing deformation of the cathode chamber frame 38 due to loads upon such cell units stacked one upon another. It is thus possible to set up an electrolyzer having great ridigity.

As shown in FIG. 4(B) that a sectional view taken on line C—C of FIG. 3(A), an anode retainer member 10 at a bottom portion of the electrolyzer is provided with a port 40 for injection of a downflow fluid. An anode fluid separated from the gas in the gas-liquid separation chamber, going down through the anode fluid-circulating path 16 defined by the anode retainer member 10 and the anode chamber partition 8, is injected from the downflow fluid port 40 into the electrode chamber. Then, the thus injected fluid is mixed with an anode fluid injected from an anode fluid-injecting port 18 into the anode chamber by way of an anode fluid supply path 41 provided in the lower portion of the anode chamber joined to an anode fluid supply pipe, and the mixture is electrolyzed at the anode 15.

Likewise, a cathode fluid going down from an opening at the bottom portion of the cathode retainer member 21 is injected into the bottom portion of the cathode chamber 7, and electrolyzed at the cathode 20 together with a cathode fluid injected from a cathode fluid-injecting port 43 by way of a cathode fluid supply path 42.

At the bottom portion of the ion exchange membrane electrolyzer 1 there is provided an electrolyzer frame 44 that retains a mechanical structure of the electrolyzer and maintains the rigidity of the electrolyzer.

Figure 5:
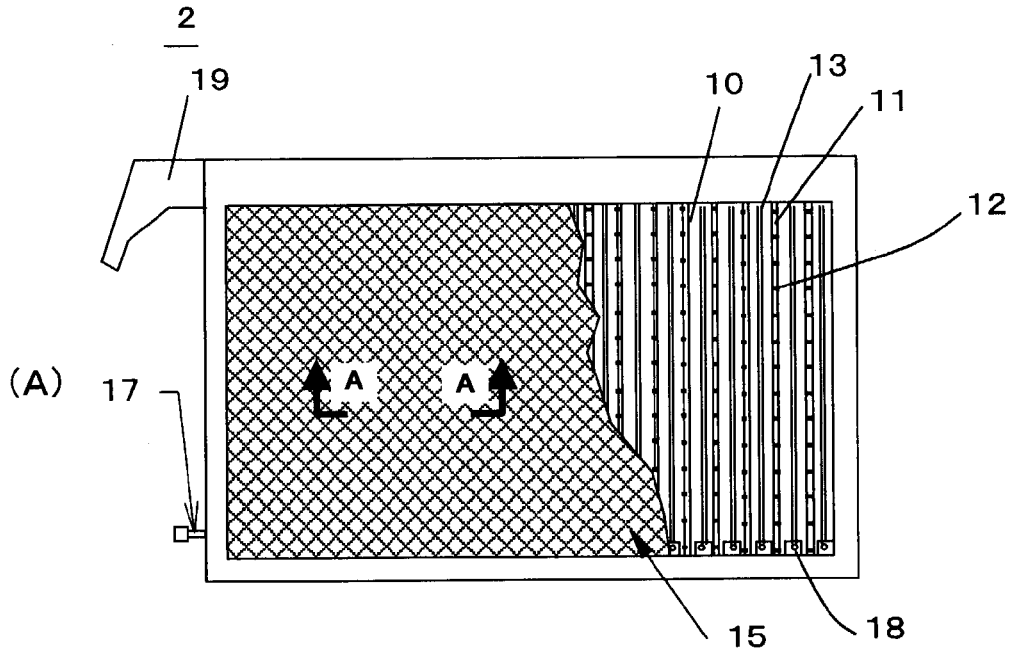
FIGS. 5(A) and 5(B) are illustrative of yet another embodiment of the ion exchange membrane electrolyzer according to the present invention.
Figure 5:
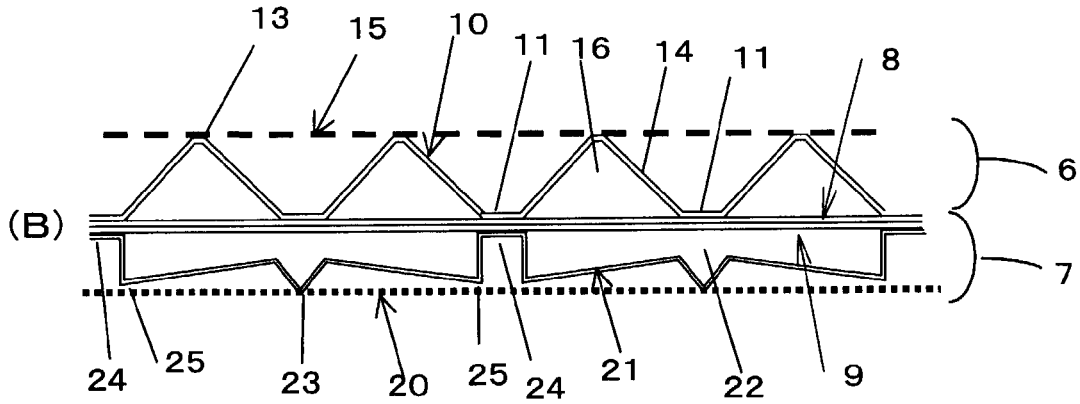

FIGS. 5(A) and 5(B) are illustrative of yet another embodiment of the ion exchange membrane electrolyzer of the present invention.

FIG. 5(A) is a schematic of an electrolyzer unit cell as viewed from an anode chamber side, and FIG. 5(B) is a sectional view taken on line A—A of FIG. 5(A).

A bipolar electrolyzer cell unit 2 for the ion exchange membrane electrolyzer is made up of an anode chamber 6 and a cathode chamber 7. An anode chamber partition 8 in a flat sheet form is electrically and mechanically joined to and integrated with the anode chamber 6 while a cathode chamber partition 9 again in a flat sheet form is electrically and mechanically joined to and integrated with the cathode chamber 7.

An anode retainer member 10 is joined to the anode chamber partition 8 at a belt-like junction 11. More specifically, at the belt-like junction 11 the anode chamber partition 8 and the anode retainer member 10 are joined together in a close contact relation. It is noted that both are not necessarily joined together by welding at a continuous welding site; in other words, while both come into close contact with each other, it is acceptable to carry out welding at a number of spot welding sites 12, so that the anode retainer member 10 and the anode chamber partition 8 can be joined together in a close contact relation, thereby ensuring that an electrically conducting connection is made between both and a space defined by the anode retainer member 10 and the anode chamber partition 8 is isolated from the opposite space.

A projecting strip 13 is formed between adjacent belt-like junctions 11 of the anode retainer member 10, and is joined to the belt-like junctions 11 by way of planar potions 14. An anode 15 is joined to the projecting strip 13 at plural sites, thereby ensuring that the anode is retained in place and an electrolytic current is passed to the anode.

The projecting strip 13 should preferably have a width large enough to join the electrode to its apex. The projecting strip may be formed by configuring a metal sheet to a triangle shape by bending or, alternatively, the projecting strip may have a plane parallel with the partition. It is also acceptable to prepare the anode retainer member as separate pieces or a member of mutually joined pieces by press molding. Moreover, all anode retainer members to be located on the anode partition may be formed by press molding of one metal sheet.

In the cathode chamber 7, a cathode retainer member 21 includes between adjacent junctions 24 at least three flexible electrode-supporting members with projecting strips each extending away from junctions with the partition. The electrode is jointed to the projecting strip 23 of such projecting strips, which has the largest amount of displacement upon pressed toward the cathode chamber partition, and a junction side strip 25 is located at an angle of about 90° with the junction 24.

Even when the ion exchange membrane is urged from the anode chamber side onto the cathode chamber side due to a drop of the pressure on the cathode chamber side for some unknown reasons during the operation of the electrolyzer, it is thus ensured that the cathode 20 is retained at the junction side strips 25 having an amount of displacement smaller than that of the projecting strip 23, so that any unrecoverable deformation of the cathode 20 or the cathode retainer member 21 can be prevented.

Figure 6:
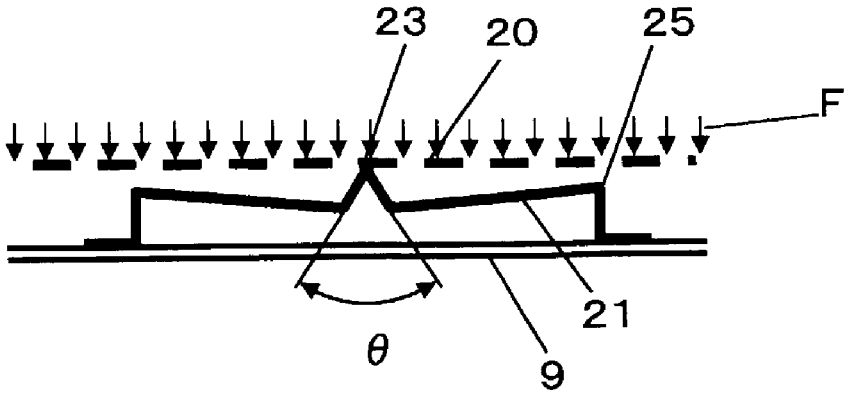
FIGS. 6(A), 6(B) and 6(C) are illustrative of how the cathode of FIGS. 5(A) and 5(B) behaves upon receipt of pressure.
Figure 6:
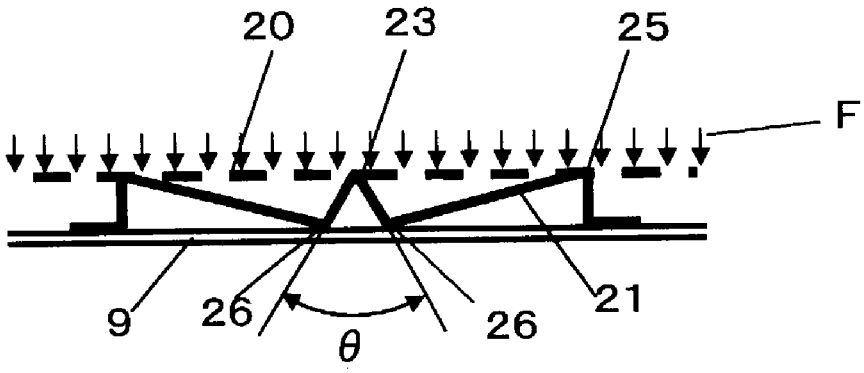
Figure 6:
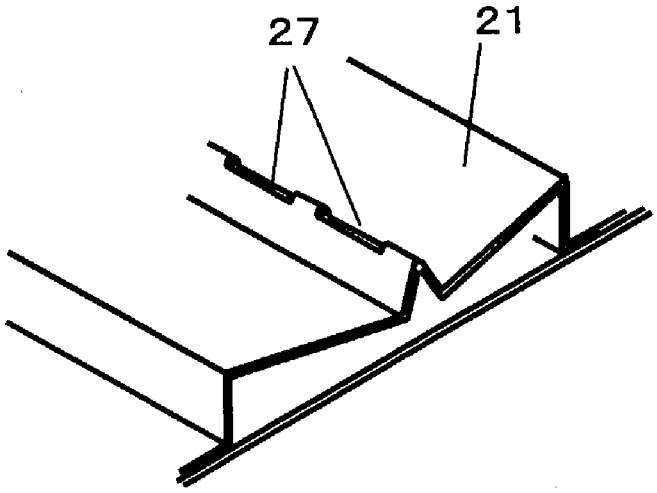

FIGS. 6(A), 6(B) and 6(C) are illustrative of how the cathode behaves upon receipt of pressure as shown in FIG. 5(B).

As the pressure on the anode chamber side becomes higher than the pressure on the cathode chamber side upon receipt of abnormal pressure during the operation of the electrolyzer, the cathode retainer member 21 displaces toward the cathode chamber partition 9 side under the action of the pressure of the ion exchange membrane on the cathode surface. Since the cathode 20 is joined to the projecting strip 23 of the projecting strips of the cathode retainer member 21 extending away from the cathode chamber partition 9, which has the largest amount of displacement toward the cathode chamber partition side, however, the cathode 20 displaces toward the cathode chamber partition 9 side when the cathode 20 is urged toward the cathode chamber partition 9 side with a force F as shown in FIG. 6(A), because the junction side strips 25 positioned on both sides of the junction have a reduced amount of displacement and so the angle of opening θ of the projecting strip 25 with the cathode joined thereto becomes large.

As shown in FIG. 6(B), if the height and the amount of displacement of the junction side projecting strip 25, the amount of the projecting strip 23 with the cathode 20 joined thereto, and the size of projecting strips 26 formed on both sides of the projecting strips with the cathode joined thereto and extending toward the cathode chamber side partition are adjusted and set in such a way that the tips of the projecting strips 26 are in contact with the cathode chamber partition 9 simultaneously upon contact of the cathode surface with the junction side projecting strips 25, it is then possible to disperse the pressure on the cathode at a number of points of contact.

The amount of displacement of the projecting member at which the cathode is joined to the cathode retainer member, for instance, may be achieved by decreasing the thickness of a part or the whole of the projecting strip 23, or forming oblong slots 27 along the longitudinal direction of the projecting strip as shown in FIG. 6(C) that is a perspective view of the cathode retainer member, thereby providing a larger deformation upon receipt of pressure of the projecting strip as compared with the rest of the cathode retainer member.

Consequently, upon receipt of pressure, the angle of opening θ of the projecting strip becomes large by relatively low pressure, so that the projecting strip is deformed in the cathode partition direction.

The cathode attached to the projecting strip that displaces by low pressing force ensures stable operation of the electrolyzer in a normal operation state, because even when the projecting strip is located proximately to the cathode surface, there is no possibility that large pressure may be exerted on the ion exchange membrane surface, causing damage to the ion exchange membrane, etc.

Figure 7:
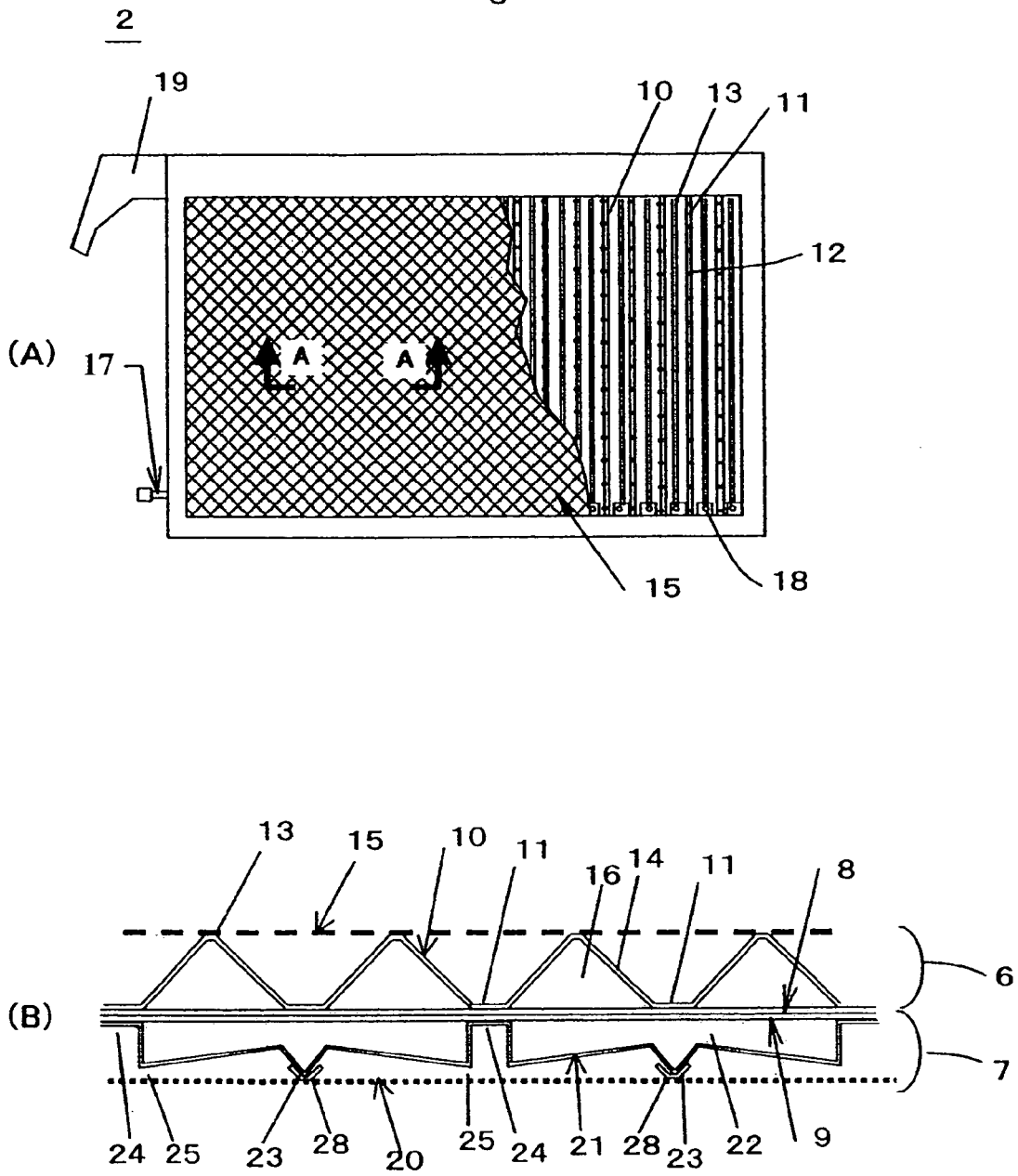
FIGS. 7(A) and 7(B) are illustrative of a further embodiment of the ion exchange membrane electrolyzer according to the present invention.
Figure 8:
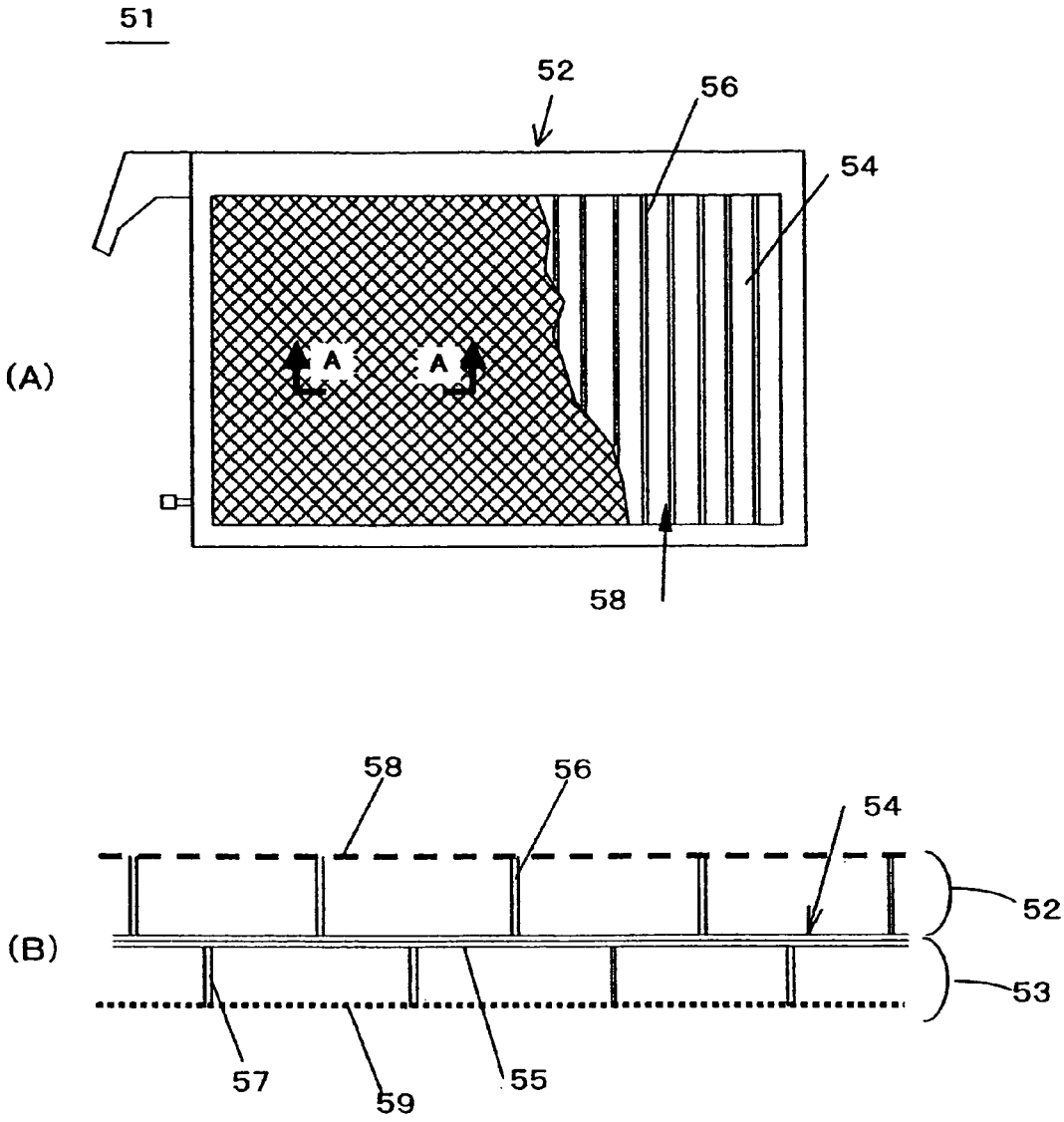
Fig.8 (PRIOR ART)
FIGS. 8(A) and 8(B) are illustrative of a prior art ion exchange membrane electrolyzer.
Figure 9:
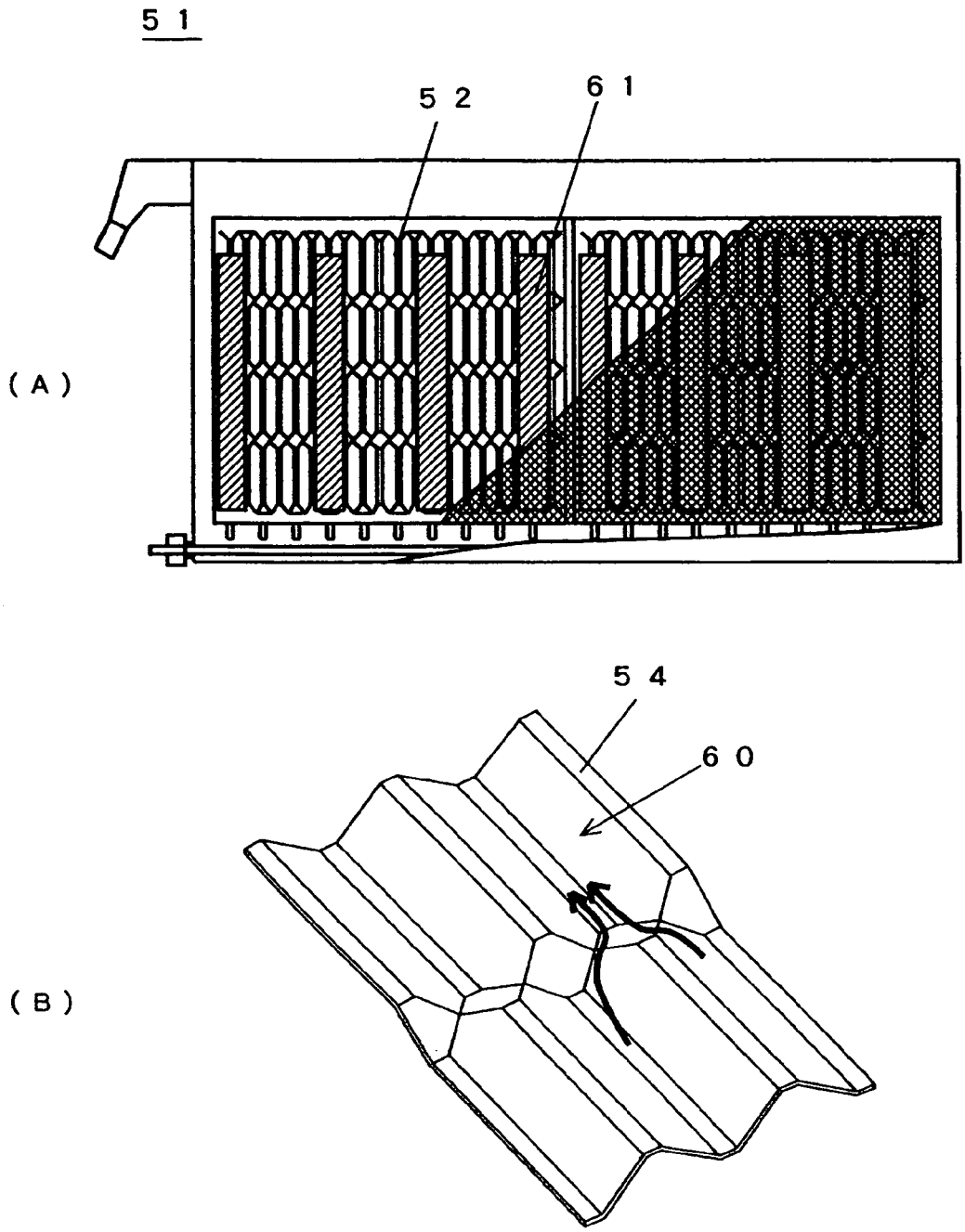
Fig.9 (PRIOR ART)
FIGS. 9(A) and 9(B) are illustrative of a prior art ion exchange membrane electrolyzer of another construction.

FIGS. 7(A) and 7(B) are illustrative of a further embodiment of the ion exchange membrane electrolyzer according to the present invention.

FIG. 7(A) is a schematic of an electrolyzer cell unit as viewed from an anode chamber, and FIG. 7(B) is a sectional view taken on line A—A of FIG. 7(B).

A bipolar electrolyzer cell unit 2 for the ion exchange membrane electrolyzer is made up of an anode chamber 6 and a cathode chamber 7. An anode chamber partition 8 in a flat sheet form is electrically and mechanically joined to and integrated with the anode chamber 6 while a cathode chamber partition 9 again in a flat sheet form is electrically and mechanically joined to and integrated with the cathode chamber 7.

An anode retainer member 10 is joined to the anode chamber partition 8 at a belt-like junction 11. More specifically, at the belt-like junction 11 the anode chamber partition 8 and the anode retainer member 10 are joined together in a close contact relation. It is noted that both are not necessarily joined together by welding at a linear welding site; in other words, while both come into close contact with each other, it is acceptable to carry out welding at a number of spot welding sites 12, so that the anode retainer member 10 and the anode chamber partition 8 can be joined together in a close contact relation, thereby ensuring that an electrically conducting connection is made between both and a space defined by the anode retainer member 10 and the anode chamber partition 8 is isolated from the opposite space.

A projecting strip 13 is formed between adjacent belt-like junctions 11 of the anode retainer member 10, and is joined to the belt-like junctions 11 by way of planar potions 14. An anode 15 is joined to the projecting strip 13 at plural sites, thereby ensuring that the anode 15 is retained in place and an electrolytic current is passed to the anode.

In the cathode chamber 7, a cathode retainer member 21 includes between adjacent junctions 24 at least three flexible electrode-supporting members with projecting strips each extending away from junctions with the partition. The electrode is jointed to the projecting strip 23 of such projecting strips, which has the largest amount of displacement upon pressed toward the cathode chamber partition, is provided with oblong slots at a spacing in the direction of the projecting strip, thereby ensuring an increased displacement of the projecting strip 23. In addition, a protective member 28 is provided for the projecting strip 23.

The provision of the protective member 28 for the projecting strip 13 ensures the sites for welding the cathode 20 to the projecting strip 23, which may not otherwise be secured when the thickness of the projecting strip 23 is reduced or the oblong slots are provided along the projecting strip 23 for the purpose of making the amount of displacement of the cathode retainer member 21 large.

The angle of opening θ of the protective member 28 for the projecting strip should preferably be the maximum angle of opening of the projecting strip that comes into contact with a junction side projecting strip 25. It is thus possible to prevent too large deformation of the projecting strip even when the projecting strip is opened upon receipt of pressure. If the protective member for the projecting strip is formed of a material larger in thickness and rigidity than the cathode retainer member, it is then possible to place some limitations on too large deformation of the projecting strip upon receipt of abnormally large pressure, thereby enhancing the action on preventing deformation of the cathode.

It is also preferable that the angle of a plane connecting the junction 24 with the junction side projecting strip 25 with the cathode chamber partition is in the range of 90° to 100° inclusive. At this angle, deformation of the cathode retainer member can be reduced when the cathode is urged against the junction side projecting strip 25, so that any unrecoverable deformation of the cathode 20 or the cathode retainer member can be prevented.

The ion exchange membrane electrolyzer of the present invention may be prepared by stacking a plurality of bipolar electrolyzer cell units, each comprising an anode chamber and a cathode chamber as described above, one upon another, and stacking at both ends a cathode side end electrolyzer cell unit comprising a cathode chamber alone and an anode side end electrolyzer cell unit comprising an anode chamber alone.

For the anode chamber partition of the ion exchange membrane electrolyzer according to the present invention, metals capable of forming thin films such as titanium, tantalum and zirconium or their alloys may be used. For the anode use may be made of those obtained by coating the surface of metals capable of forming thin films such as titanium, tantalum and zirconium or their alloys with an electrode catalyst substance containing platinum-group metals or their oxides.

For the cathode chamber partition, nickel, nickel alloys, etc. may be used, and for the cathode use may be made of nickel or nickel alloys in a porous or network form or expanded metals or those obtained by coating such substrates with electrode catalyst substance coatings such as layers containing platinum-group metals, Raney nickel, and activated carbon-containing nickel. The same material as that of the cathode chamber partition may be used for forming the cathode fluid-circulating path.

The anode and cathode retainer members may be formed of the same materials as the anode and cathode chamber partition materials, respectively. Alternatively, separately prepared anode and cathode retainer members may be joined to the anode and cathode chamber partitions, respectively. Still alternatively, a plurality of anode and cathode retainer members or all anode and cathode retainer members may be prepared by press molding in one-piece members that may be joined to the anode and cathode chamber partitions, respectively.

When the ion exchange membrane electrolyzer of the present invention is used for electrolysis of aqueous solutions of alkaline metal halides, for instance, for electrolysis of brine, saturated brine is fed to the anode chamber while water or a dilute aqueous solution of sodium hydroxide is fed to the cathode chamber, and after electrolysis at a given rate of electrolysis, the product is taken out of the electrolyzer.

For electrolysis of brine in the ion exchange membrane electrolyzer, the pressure of the cathode chamber is kept higher than the pressure of the anode chamber, and the ion exchange membrane is operated while coming in close contact with the anode. Since the cathode retainer member is a springy member and the cathode is joined to the projecting strip having a large amount of displacement, however, it is possible to carry out electrolysis while the cathode is brought close to the ion exchange membrane surface at a given distance.

According to the ion exchange membrane electrolyzer of the present invention, an anode chamber partition in a flat sheet form is joined to a cathode chamber partition in a flat sheet form, an electrode retainer member in a sheet form is joined to at least one of said anode chamber partition and said cathode chamber partition at a belt-like junction, a projecting strip with an electrode joined thereto is located between adjacent junctions, a space on an electrode surface side of said electrode retainer member defines a path through which a fluid goes up in the electrode chamber, and a space that spaces away from said space defines a path through which an electrolyte separated from a gas at a top portion of the electrode goes down. It is thus possible to provide an efficient circulation of electrolyte and locate the electrode retainer member all over the surface. Accordingly, it is possible to obtain an ion exchange membrane electrolyzer having great rigidity.

What we claim is:

1. An ion exchange membrane electrolyzer, wherein:

an anode chamber partition in a flat sheet form is joined to a cathode chamber partition in a flat sheet form, an electrode retainer member in a sheet form is joined to at least one of said anode chamber partition and said cathode chamber partition at a belt-like junction, a projecting strip with an electrode joined thereto is located between adjacent junctions, a space on an electrode surface side of said electrode retainer member defines a path through which a fluid goes up in the electrode chamber, and a space that spaces away from said space defines a path through which an electrolyte separated from a gas at a top portion of the electrode goes down, wherein said electrode retainer member comprises a springy member, said springy member is formed of a flexible member comprising between the adjacent junctions at least three projecting strips extending away from a junction side with the partition, and said electrode is joined to a projecting strip of said projecting strips, which has a largest amount of displacement upon receipt of pressure;

wherein the projecting strip is joined with the electrode via a protective member for the projecting strip, wherein when the electrode is urged toward a partition side, an angle of opening of said protective member upon the electrode coming into contact with a projecting strip near to a junction defines a maximum angle of opening of the projecting strip.

2. The ion exchange membrane electrolyzer according to claim 1, wherein the amount of displacement of the projecting strip with the electrode joined thereto is increased by partial notching.

3. The ion exchange membrane electrolyzer according to claim 1, wherein when the electrode is urged toward a partition side, movement of the electrode is limited by a projecting strip adjacent to a junction.

4. The ion exchange membrane electrolyzer according to claim 3, wherein the projecting strip having the largest amount of displacement is formed by partial notching.

5. The ion exchange membrane electrolyzer according to clam 4, wherein the projecting strip having the largest amount of displacement is joined with the electrode via a protective member for the projecting strip, wherein an amount of displacement of said protective member upon the electrode coming into contact with a projecting strip near to a junction is given by a maximum angle of opening of the projecting strip.

6. The ion exchange membrane electrolyzer according to claim 5, wherein when the electrode joined to the projecting strip having the largest amount of displacement is urged toward a partition side, movement of the electrode is limited by a projecting strip adjacent to a junction.

* * * * *